US005461811A

United States Patent [19]

Ciener

[11] Patent Number: 5,461,811

[45] Date of Patent: Oct. 31, 1995

[54] GUN MAGAZINE APPARATUS AND METHOD

[76] Inventor: Jonathan A. Ciener, 104 La Riviere Rd., Cocoa Beach, Fla. 32931

[21] Appl. No.: 328,166

[22] Filed: Oct. 24, 1994

[51] Int. Cl.[6] ..... F41A 9/65

[52] U.S. Cl. ..... 42/50; 42/4902

[58] Field of Search ..... 42/50, 49.02

[56] References Cited

U.S. PATENT DOCUMENTS

| | | | |
|---|---|---|---|
| 1,833,862 | 11/1931 | Schmeisser | 42/50 |
| 2,396,816 | 3/1946 | Boudreau | 42/50 |
| 3,724,326 | 4/1973 | Day | 89/196 |
| 3,772,812 | 11/1973 | Day | 42/7 |
| 4,058,922 | 11/1977 | Elbe et al. | 42/16 |
| 4,069,608 | 1/1978 | Jurek | 42/49 |
| 4,079,535 | 3/1978 | Elbe et al. | 42/49 |
| 4,139,958 | 2/1979 | Foote | 42/49 |
| 4,297,800 | 11/1981 | Atchisson | 42/50 |
| 4,514,922 | 5/1985 | Farrar et al. | 42/50 |
| 4,589,218 | 5/1986 | Teppa | 42/50 |
| 4,862,619 | 9/1989 | Baldus et al. | 42/7 |
| 5,329,718 | 7/1994 | Howard | 42/50 |

*Primary Examiner*—Charles T. Jordan
*Assistant Examiner*—Christopher K. Montgomery
*Attorney, Agent, or Firm*—William M. Hobby, III

[57] ABSTRACT

A cartridge magazine for a gun includes a machined magazine body having an open edge and open bottom and a separate edge plate slidably attachable to the magazine body to cover the open edge and a floor plate slidably attachable to the magazine body to cover the open bottom and to lock the edge plate in place. A cylindrical coil spring is held in position in the magazine body and has a cartridge follower on one end and a spring base plate on the other which base plate has a detent member for locking to the floor plate for holding the cartridge magazine together. The process selects the components and assembles them by positioning the spring in the spring supporting portion of the magazine body, sliding the edge plate into position and then sliding the floor plate into position to lock the edge plate, floor plate and follower spring together.

13 Claims, 1 Drawing Sheet

GUN MAGAZINE APPARATUS AND METHOD

BACKGROUND OF THE INVENTION

The present invention relates to a cartridge magazine for a gun and especially to a conversion cartridge magazine for use in converting a gun to a smaller caliber.

The present invention is a magazine adapter principally for use with automatic and semi-automatic firearms, such as pistols, which magazines can conventionally have a magazine body with a floor plate and a spring in the magazine body having a cartridge follower to move the cartridges forward. As each cartridge is chambered, the next cartridge moves forward in the magazine under spring pressure. In recent years, it has become common practice to convert pistols and rifles to use a different caliber bullet than the firearm had been originally manufactured for. This has been particularly the case in the conversion of larger caliber firearms to .22 caliber automatic pistols and rifles. Firearms of this character are favored for target practice and training and have a reduced cost of ammunition over the larger caliber firearms.

The present invention is adapted for use in converting a Colt Army .45 caliber (Model M1911A1) for use with .22 caliber rimfire cartridge but may be used with any conversion desired. In the typical automatic or semiautomatic firearms, each cartridge is moved forward by the magazine spring pushing the follower and the cartridges. The follower has a forwardly moving slide and the weapon loads each cartridge by moving the top cartridge into the chamber. In addition to converting the magazine, the conversion of a firearm requires that the barrel be sized for the new cartridge and the receiver be such as to be able to fire a rimfire cartridge in place of a center fire cartridge and have sufficient recoil to drive the receiver back to eject one cartridge shell while chambering the next cartridge shell.

The present invention is directed towards a converted firearm cartridge magazine for converting to a smaller caliber, which magazine is made of a machined metal, such as machined aluminum alloy, and has rapidly interconnecting parts and which also is adapted to support a coiled spring for use as a magazine spring. The machined alloy allows the magazine to be made the same size as the larger caliber magazine on the outside while the inside is machined for the smaller size cartridges without having to otherwise take up the slack. It has been suggested in the past to form a magazine of a molded plastic body but such magazine body tends to be more prone to breakage and damage in normal use.

Prior art magazines for use in conversion of the calibers of firearms or for extending the magazines in automatic weapons can be seen in U.S. Pat. No. 2,396,816 to Boudreau which has a magazine conversion unit and special adapter for use in connection with magazines to permit the magazine to hold and the gun to fire cartridges of lesser firing power but of the same caliber than the gun is normally adapted for. The Baldus et al. U.S. Pat. No. 4,862,619, is a Magazine Adapter made of a one-piece cast or molded polymer magazine for use with an extended magazine for a firearm and includes a magazine adapter that attaches to the bottom of the handle of a pistol for holding a smaller magazine in a specially formed area. The Baldus et al. patent also includes a floor plate for the spring which has a slide type floor plate detentably secured against removal by the sidetracks formed by the rolled flanking edges of the magazine and which plate serves as a retainer against the thrust of a follower spring.

The Farrar et al. U.S. Pat. No. 4,514,922, is a Gun Magazine Structure for holding a series of rounds of ammunition and has a floor plate at the lower end of the magazine detachable therefrom by a sliding movement relative to the body. The floor plate of the magazine is connected to the magazine body loosely and is held in place by locking means for blocking lateral separation of the floor plate from the magazine body and held from sliding by the pressure from the spring. The Foote U.S. Pat. No. 4,139,958, is for a Magazine Adapter Assembly for Firearms for conversion of an automatic or semiautomatic shotgun or rifle to a smaller caliber. The Day U.S. Pat. Nos. 3,772,812 and 3,724,326, each show Sub-Caliber Conversion Units including a sub-caliber magazine insert attachably secured in the magazine of a larger caliber pistol so that the pistol can use sub-caliber cartridges. The Elbe et at. U.S. Pat. No. 4,079,535 is a Magazine for a rimfire adapter to feed cartridges into a rifle. The Jurek U.S. Pat. No. 4,069,608, is a .22 caliber rimfire adapter system for an M16 rifle and the Elbe et al. U.S. Pat. No. 4,058,922, is a Rifle Adapter Assembly for converting a rifle to fire ammunition of different shape or type of caliber than the rifle was originally designed for.

SUMMARY OF THE INVENTION

A cartridge magazine for a gun includes a machined magazine body having an open edge and open bottom and a separate edge plate slidably attachable to the magazine body to cover the open edge and a floor plate slidably attachable to the magazine body to cover the open bottom and to lock the edge plate in place. A cylindrical coil spring is held in position in the magazine body and has a cartridge follower on one end and a spring base plate on the other which face plate has a detent member for locking to the floor plate for holding the cartridge magazine together. The process selects the component and assembles them by positioning the spring in the spring supporting portion of the magazine body, sliding the edge plate into position and then sliding the floor plate into position to lock the edge plate, floor plate and spring together.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
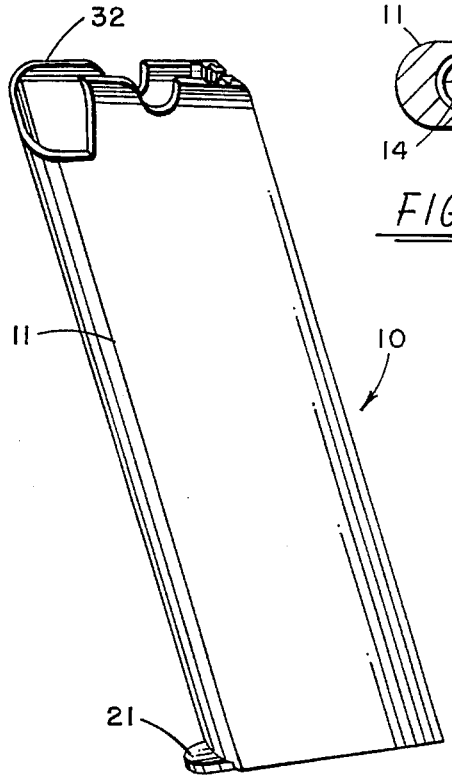
FIG. 1 is a perspective view of a cartridge magazine in accordance with the present invention.
Figure 5:
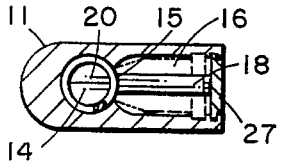
FIG. 5 is a sectional view taken on the line 5—5 of FIG. 2.
Figure 2:
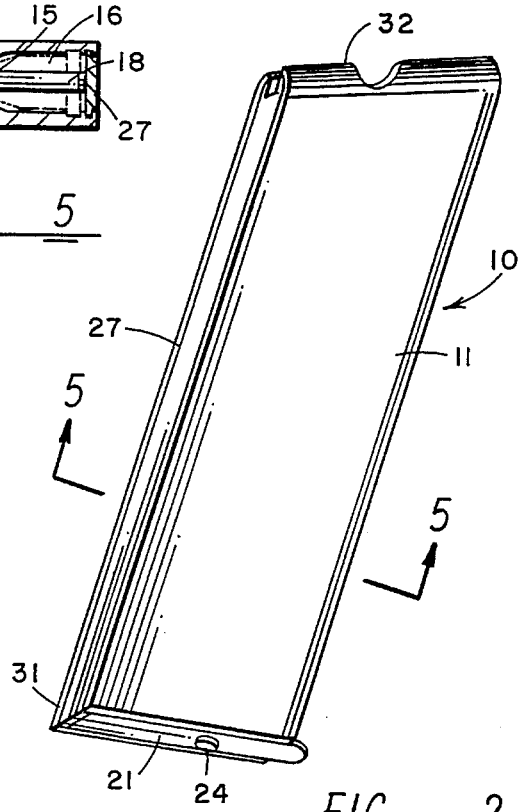
FIG. 2 is a perspective view of the magazine of FIG. 1.
Figure 3:
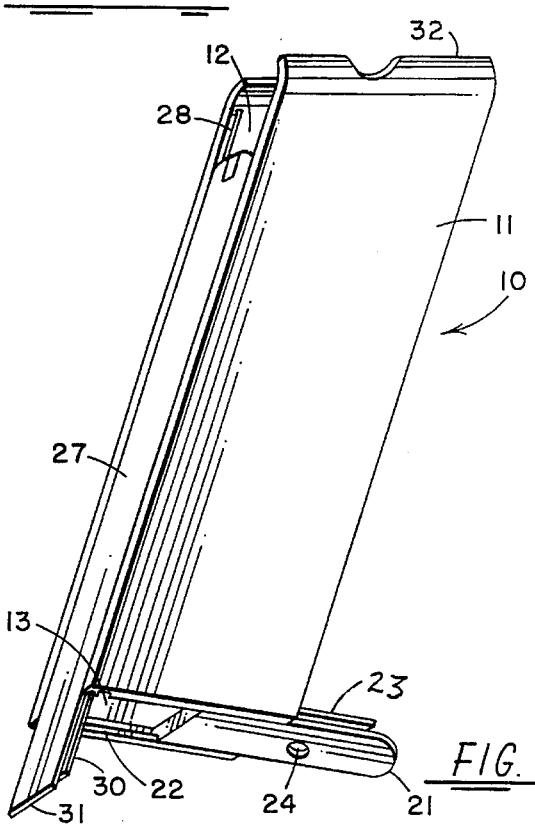
FIG. 3 is a perspective view of the magazine of FIGS. 1 and 2 having the sliding edge and floor plate partially removed.
Figure 4:
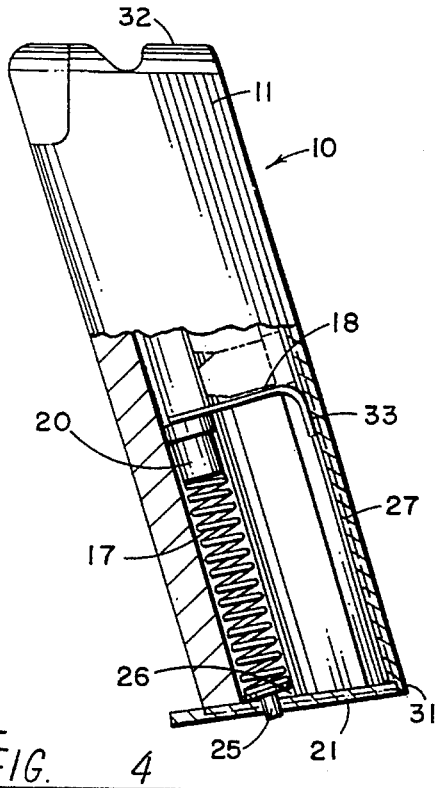
FIG. 4 is a cut-away perspective of the cartridge magazine of FIGS. 1–3.

Referring to the drawings FIGS. 1–5, a firearm cartridge magazine 10 is especially adapted for use in conversion of a firearm of the automatic or semiautomatic type, especially a pistol conversion, such as converting the magazine of a U.S. Military 1911A 1 .45 ACP center fire pistol for use with .22 caliber rimfire cartridges. The magazine 10 has a magazine body 11 having an open edge 12 and an open body 13 and is a machined body, machined out of an aluminum alloy or the like, which has a cylindrical bore 14 extending down the length of the magazine body 11 with an open portion 15 opening into the remainder of the hollow interior 16 of the body 11. A generally cylindrical coiled spring 17 fits within the cylindrical bore 14 and has a cartridge follower 18 attached to the top thereof with a spring follower attaching member 20. The follower extends into the hollow portion 16 where the cartridges are being pushed by the follower from the pressure from the coil spring 17. A floor plate 21 is attached to the bottom of the body 11 by sliding in grooves 22. The grooves 22 are sized to receive the elongated edge ridges 23 on both sides of the bottom plate 21. The bottom plate 21 also has an aperture 24 therethrough positioned in a predetermined position for receiving a generally cylindrical detent member 25 which is formed on a spring base plate 26 on the bottom of the coil spring 17.

An edge plate 27 is shaped to cover the opening 12 in the magazine body 11 by sliding into a pair of elongated edge plate interior grooves 28. The edge plate 27 has elongated edge ridges 30 on either side thereof shaped to slide within the grooves 28. The edge plate is thus inserted either before or after the spring 17 is inserted into the body 11 and then the floor plate 21 is slid into the bottom until it overlaps the bottom 31 of the edge plate to thereby lock the edge plate 27 in place covering the edge opening of the magazine body 11. At this point, the aperture 24 aligns with the center of the coil spring 17 supported in the bore 14 so that the base plate 26 detent 25 snaps into the aperture 24 to thereby lock floor plate 21 into position with one edge fitting into a notch on the edge 31 of the edge plate 27 to thereby hold the entire magazine assembly together.

To disassemble the magazine merely requires that the cylindrical detent member 25 be pushed in with a small pointed tool or member until the floor plate 21 can be slid to bring the aperture 24 out of alignment with the detent 25 and to uncover the edge 31 of the end of plate 27 to thereby allow the edge plate 27 to slide out and the floor plate 21 to slide out, and then to remove the coil spring 17. The magazine body 11 has curved end portions 32 for loading cartridges into the magazine as well to allow the receiver to chamber the cartridge. The magazine cartridge follower 18 is held in position by being attached to the follower spring attaching member 20 and also by having a curved end portion 33 and a neck that fits more precisely through the opening 15 so that the follower 18 is held in position as it moves in the magazine body.

It should be clear at this time that a firearm magazine for use in automatic or semiautomatic pistols or rifles has been provided especially one which can be made of a machined aluminum or metal magazine body which easily interlocks the members together for ease in assembling or disassembling but it should also be clear that the present invention is not to be construed as limited to the forms shown which are to be considered illustrative rather than restrictive.

I claim:

1. A magazine comprising:

a magazine body machined from a block of aluminum alloy and having an open edge having a pair of grooves along the inside thereof and an open bottom having a pair of inside grooves along the inside thereof;

an edge plate slidably attachable to said magazine body in said pair of grooves along the inside of said magazine body inside edge to cover the open edge thereof;

a floor plate slidably attachable to said magazine body in said pair of grooves along the inside of said magazine body open bottom to cover the open bottom thereof and one end of said edge plate; and a spring positioned inside said magazine body for urging bullets in the magazine body upward in the magazine, said spring having a cartridge follower on one end thereof and a spring base plate on the other end thereof yieldably connected to said floor plate to lock said floor plate in place on the bottom of said magazine body whereby a magazine is formed of a plurality of interconnecting parts locking together.

2. A magazine in accordance with claim 1 in which said floor plate has an aperture therein and said spring base plate has a detent member shaped to fit in said floor plate aperture.

3. A magazine in accordance with claim 2 in which said spring base plate is a plate having a generally cylindrical protrusion therefrom shaped to fit into said aperture in said floor plate.

4. A magazine in accordance with claim 3 in which said edge plate has an elongated ridge on each edge thereof shaped to fit into said magazine body grooves along the open edge of said magazine body.

5. A magazine in accordance with claim 5 in which said floor plate has an elongated ridge on each edge thereof shaped to fit into said grooves along the inside of said magazine body open bottom.

6. A magazine in accordance with claim 5 in which said magazine body has a cylindrical coiled spring supporting bore therein and said spring is a cylindrically coiled spring held therein.

7. A process for making a magazine comprising the steps of:

selecting a block of aluminum alloy;

shaping said block of aluminum alloy to form a magazine body having an open edge and open bottom;

selecting an edge plate for slidably attaching to said magazine body to cover the open edge thereof;

selecting a floor plate for slidably attaching to said magazine body to cover the open bottom thereof and one end of said selected edge plate;

selecting a spring shaped to be positioned inside said magazine body for urging bullets in the magazine body upward in the magazine body, said selected spring having a cartridge follower on one end thereof and a spring base plate on the other end thereof;

positioning said spring in said shaped aluminum alloy magazine body;

sliding said selected edge plate into edge grooves in said magazine body to generally cover said magazine body open edge; and sliding said selected floor plate into bottom grooves in said magazine open bottom until one edge covers the end of said selected edge member to thereby lock said selected edge member to said magazine body, whereby a magazine is formed of a plurality of interconnecting parts locking together.

8. A process for making a magazine in accordance with claim 7 in which the step of selecting a floor plate includes selecting a floor plate having an aperture therein for receiving a detent portion of said spring base plate.

9. A process for making a magazine in accordance with claim 7 in which the step of shaping a block of aluminum alloy to form a magazine body includes forming a magazine body having a generally cylindrical bore therein to hold a generally cylindrical coiled spring in position.

10. A process for making a magazine in accordance with claim 9 in which the step of shaping a block of aluminum alloy to form a magazine body includes forming a magazine body having a pair of grooves along the inside of said edge opening shaped to slidably receive the edges of said edge plate.

11. A process for making a magazine in accordance with claim 10 in which the step of selecting an edge plate includes selecting an edge plate having an elongated ridge on each edge thereof shaped to fit into said magazine body grooves along the edge opening of said magazine body.

12. A process for making a magazine in accordance with claim 11 in which the step of shaping a block of aluminum alloy to form a magazine body includes forming a magazine body having a pair of grooves along the inside of said open bottom shaped to slidably receive the edges of said floor plate.

13. A process for making a magazine in accordance with claim 12 in which the step of selecting a floor plate includes selecting a floor plate having an elongated ridge on each edge thereof shaped to fit into the grooves along the inside of said magazine body open bottom.

* * * * *